US005574434A

United States Patent [19]

Liu

[11] Patent Number: 5,574,434

[45] Date of Patent: Nov. 12, 1996

[54] ALARM FOR HEAT MULTISTAGED DETECTING

[76] Inventor: Hung-Chang Liu, No. 1, Lane 56, Sec. 2, Ta Cheng Rd., Tainan City, Taiwan

[21] Appl. No.: 514,004

[22] Filed: Aug. 11, 1995

[51] Int. Cl.[6] ..... G08B 17/00

[52] U.S. Cl. ..... 340/534; 340/587; 340/636

[58] Field of Search ..... 340/584, 587, 340/636, 577, 578, 506, 507, 517, 588, 589

[56] References Cited

U.S. PATENT DOCUMENTS

| | | | |
|---|---|---|---|
| 3,728,615 | 4/1973 | Hill et al. | 340/589 |
| 4,149,159 | 4/1979 | Datwyler et al. | 340/586 |
| 4,195,286 | 3/1980 | Galvin | 340/587 |
| 4,287,515 | 9/1981 | Raber et al. | 340/584 |
| 4,597,451 | 7/1986 | Moore et al. | 340/587 |
| 4,634,294 | 1/1987 | Christol et al. | 340/584 |
| 4,679,156 | 7/1987 | Kern et al. | 360/587 |
| 4,697,172 | 9/1987 | Kimura | 340/587 |
| 5,005,003 | 4/1991 | Ryser et al. | 340/587 |
| 5,450,066 | 9/1995 | Brighenti et al. | 340/596 |

*Primary Examiner*—Jeffery Hofsass
*Assistant Examiner*—Benjamin C. Lee
*Attorney, Agent, or Firm*—Morton J. Rosenberg; David I. Klein

[57] ABSTRACT

An alarm for multistaged heat detection is provided. The alarm provides a multi-point detecting structure by applying a digital operation unit. The alarm has both pre-alarm and normal alarm modes. The digital operation unit coordinates the sound and light output to effect different alarm signals. A power capacity checking circuit is included to indicate a low operational state of the system power. A coercing alarm circuit is also included for stopping all detecting to cause the system to output an alarm signal in an emergency.

1 Claim, 3 Drawing Sheets

ALARM FOR HEAT MULTISTAGED DETECTING

BACKGROUND OF THE INVENTION

1. Field of the Invention

The present invention relates to an alarm for heat multi-staged detecting. More particularly, the present invention is directed to a system having more than two detecting inputs preset to different temperatures and having the capabilities of both providing earlier alarming and normal alarming. The alarm output method uses sound and light in combination. The present invention is provided with a battery capacity checking alarm for indicating a low operational state of the battery. In addition, the present invention provides a coercing alarm signal for output in an emergency.

2. Prior Art

With respect to existing temperature alarms or fire alarms, they are adapted with one detecting stage. The detecting unit is preset to a value according to the surrounding temperature or a fire source. When the detecting unit senses the signal matching the preset value, the circuit is triggered to alarm, reminding the user to pay attention. But the conventional way of detecting alarms has the following shortcomings:

1. Due to the unqualified detecting parts, or not enough power capacity, such causes the detecting unit to be inexact in detecting, and causes the alarm to stop or miss-act, especially when there is not enough power capacity which is not discovered by the user and causes the alarm to stop.
2. The single stage detecting alarm only works to detect when the surrounding temperature reaches the preset temperature. In the case of a fire alarm, it outputs an alarm signal after discovering the fire source, so it offers a missed opportunity to prevent the fire.
3. The conventional alarms only alarm in response to the one preset condition. If an unexpected emergency is encountered, the conventional alarm cannot be brought into play.
4. The function of the conventional alarm is unitary, it cannot be connected to an external system for sending a signal to the connected device to respond immediately thereto.
5. The conventional detecting parts must be tested before leaving the factory, and such increases the process and production cost.

Therefore, according to the above-mentioned conventional alarm's shortcomings, the object of the present invention is to provide a multi-point detecting system to ensure the reliability of the system, and provide an auto-checking device for indicating a low power operation state, to include a coercing alarm function, and provide a capability for connecting to another system.

SUMMARY OF THE INVENTION

The present invention provides a reliable multi-point detecting system that uses a digital operation unit, is provided with an auto-checking device for indicating a low power operation state, includes a coercing alarm function, and a capability for connecting to another system. The present invention includes a ROM (read only memory), an inverter, and A/D (analog/digital) converter.

DESCRIPTION OF THE PREFERRED EMBODIMENT

Figure 1:
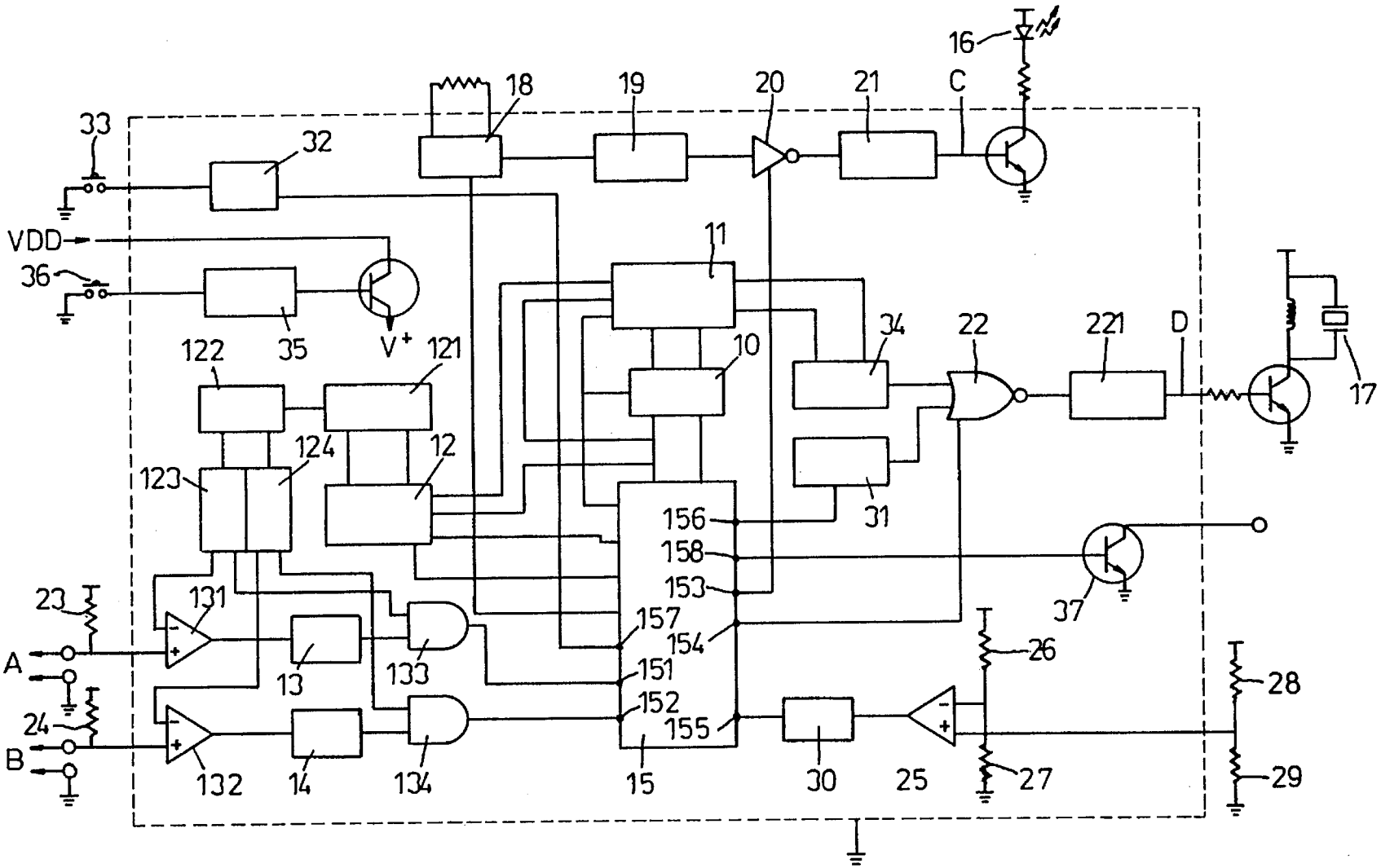
FIG. 1 is a circuit diagram of the present invention.

Referring to FIG. 1, there is shown, a circuit diagram of the present invention. The high and low parameter limits are stored in the ROM 10 as part of the system's basic design parameters. During every start-up, the preset parameters in the ROM 10 are sent through readout unit 11 to the RAM (random access memory) 12 and in which the high parameter 123 and the low parameter 124 are set by the decoder 121 and the A/D converter 122 for ensuring the high and low parameters 123 and 124 are set correctly without loss.

With the external high coefficient heat sensor A or the inferior high coefficient heat sensor B detects the variation of the exterior coefficient, the signal can be amplified by the respective operational amplifier 131, 132, and then compared with the respective preset high or low parameter limit 123, 124 in the RAM 12. The compared analog signal is converted to a digital signal by the respective A/D converter 13, 14. The digital signal is next passed to the respective AND gate 133, 134 for coupling to the terminal 151 or the terminal 152 of the digital operation unit 15. When the digital operation unit 15 receives the signal from the terminal 151 or the terminal 152, a control signal will be sent out from the terminals 153 and 154 to flash the luminous diode 16 and initiate the sounding of the buzzer 17 as an alarm.

The oscillator 18 has an extremely high frequency to provide a time clock for sequencing of the digital operation unit 15. The clock signal also becomes a digital control signal by the detector 19, when the terminal 153 of the digital operation unit 15 triggers the inverter 20. When inverter 20 is triggered, the digital signal from the detector 19 is coupled to the buffer 21 for controlling the flashing on and off of luminous diode 16.

Figure 2:
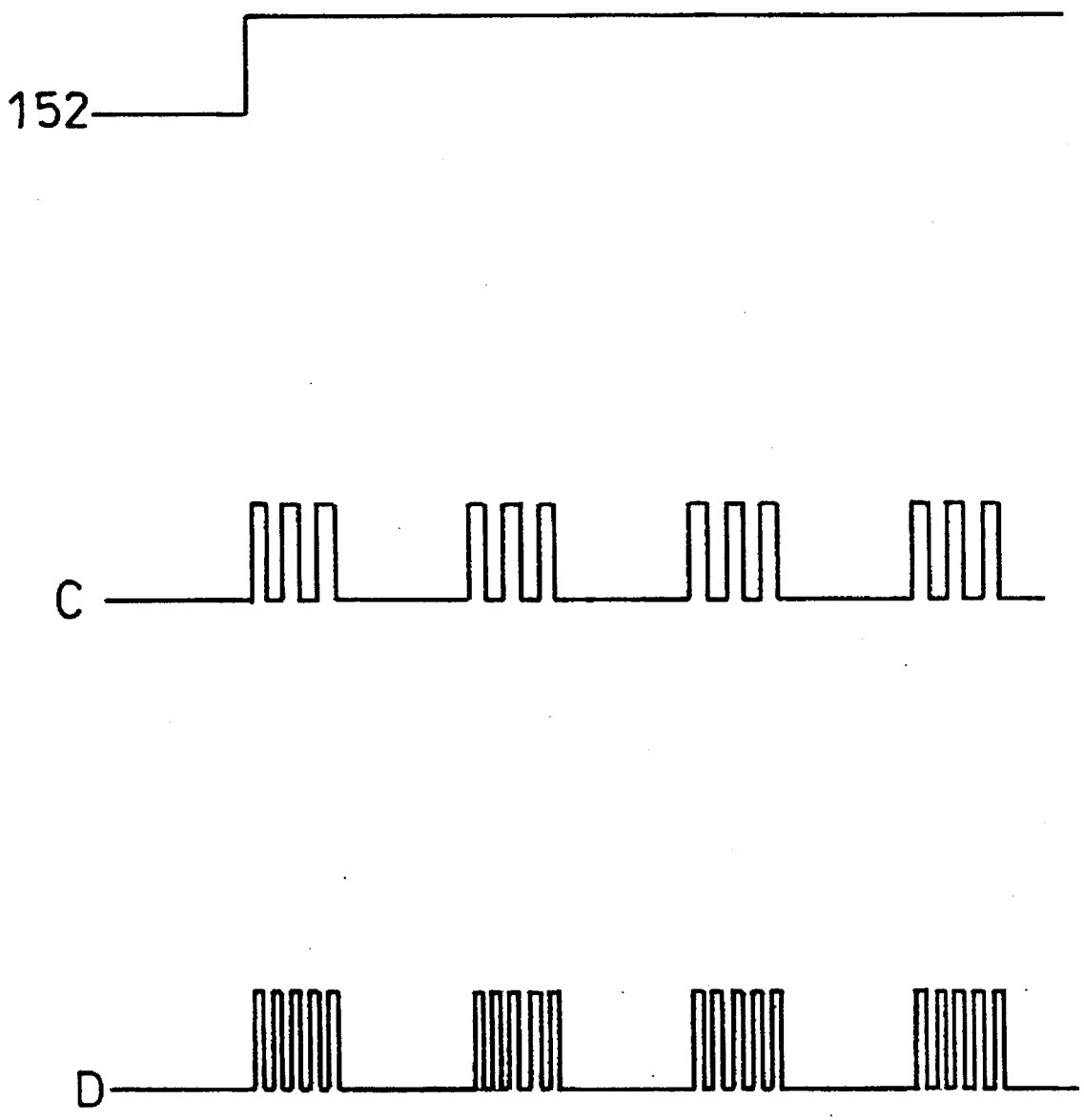
FIG. 2 is a diagram of wave patterns concerned with the present invention.

In the sound and light alarm, the actions of the luminous diode 16 and the buzzer 17 operate in a different way, depending on the signal being sensed. When the inferior high coefficient heat sensor B detects a variation of the external heat coefficient, the signal is sent into the digital operation unit 15 through the terminal 152. Responsively, signals are sent out from the terminals 153 and 154 to separately trigger the inverter 20 and the NOR gate 22 for intermittently exciting the luminous diode 16 and the buzzer 17 as an alarm output. The wave patterns on the output lines C and D of the buffers 21 and 221, and the terminal 152 are shown in FIG. 2.

Figure 3:
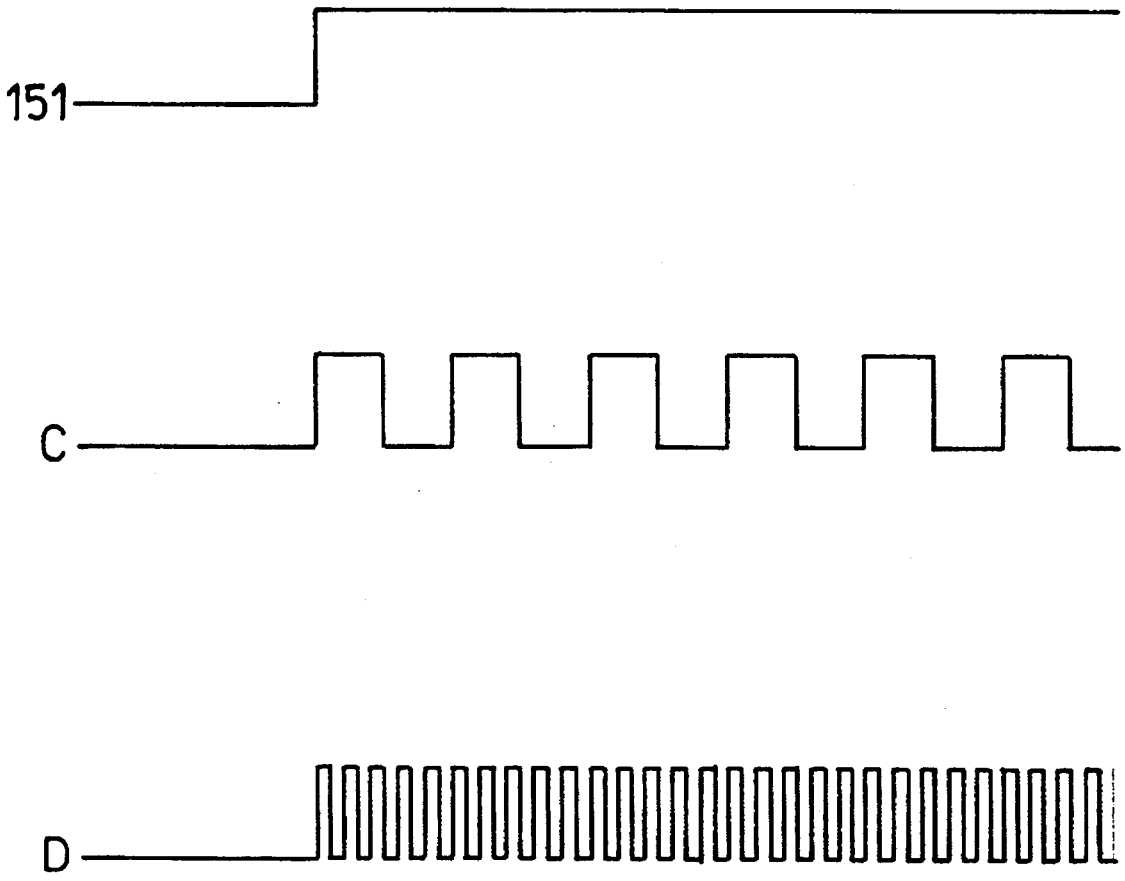
FIG. 3 is another diagram of wave patterns concerned with the present invention.

In the other case, when the high coefficient heat sensor A detects a variation of the external heat coefficient, the signal is sent to the digital operation unit 15 through the terminal 151. Responsively, signals are sent out from the terminals 153 and 154 to separately enable conduction of inverter 20 and the NOR gate 22 to create an uninterrupted plus signal output, an output that is different from the output of the above-mentioned alarm condition. In this way, the effect of the normal alarm can be distinguished from the pre-alarm. The wave patterns for this second condition is shown in FIG. 3.

Concerning the setting of the above-mentioned high and inferior heat coefficients, setting can be achieved with the adjusting resistances 23 and 24.

A power capacity checking circuit is also provided. It comprises an operational amplifier 25, two resistances 26 and 27 and an A/D converter 30. When the power capacity is not enough, the voltage on the voltage divider formed by the series resistances 28 and 29 is compared with the internal preset parameter, the voltage on the other voltage divider formed by the series resistances 26 and 27, by the operational amplifier 25. If the voltage is lower than the preset standard, the operational amplifier (comparator) 25 sends the signal to the A/D converter 30 for conversion into a digital signal. That digital signal is coupled to the digital operation unit 15 through the terminal 155. In response, the digital operation unit 15 provides an output on terminal 153 to inverter 20, to pass a signal from the oscillator 18 to flash the luminous diode 16 to indicate the lack of power capacity. The flashing diode reminds the user to change the battery at the right time, for keeping the alarm system in a ready state.

The ROM 10 stores the preset parameter limits in a digital signal state, and stores the program that controls the drive action. But due to the fact that transmission of the digital signal is less reliable than an analog signal, a compensating circuit 31 is provided for decreasing the distortion to a minimum. the lost digital signal can be sent out from the terminal 156 to trigger the compensating circuit 31 for compensating the lost signal portion that resulted from transmission distortion.

The present invention provides a flip-flop 32 having an input connected to ground through a switch 33. In an emergency, the user presses down the switch 33 to send a signal into the terminal 157. At that moment, the digital operation unit 15 will stop all detecting and go into the coercing alarm state. The coercing signal alarm state is deciphered by the decoder 34 and enables the buzzer 17 to alarm.

In addition, the electronic switch 35 coupled to switch 36 provides a necessity control for the internal battery. Each time the switch 36 is pressed down, the system changes state, from on to off or from off to on, for providing full power control. During the time when the system is not used, the power supply is cut out fully to save power.

The signal sent out from the terminal 158 of the digital operation unit 15 is amplified by the transistor 37. The amplified signal can be connected to another system, to make that system's reaction synchronous.

I claim:

1. An alarm device for multistage heat detecting and alarming, comprises:

a ROM, in which high and low parameter limits are prestored; wherein every time the device starts-up, the high and low parameter limits are sent into a RAM for storage;

a high coefficient heat sensor and an inferior high coefficient heat sensor, each detecting external heat coefficient to generate sensor output signals to be compared by a respective comparator means with said parameter limits prestored in the RAM, and the respective comparator means output signal is changed to a digital signal by an A/D converter, the digital signal is sent into a digital operation unit to perform a digital program operation;

wherein operation unit output signals are sent out to drive a luminous diode and a buzzer or additionally a connecting external system by driving circuits, wherein the driving circuit of the buzzer comprises a NOR gate connected to a buzzer buffer; wherein the driving circuit of the luminous diode comprises an extremely high frequency oscillator connected to a detector which drives the input of a triggerable inverter whose output is connected to a diode buffer, said oscillator provides a time clock signal for sequence operation of the digital operation unit, and for providing an oscillator signal for conversion to a digital signal by said detector for input to the inverter to drive said diode through said diode buffer, such that when an output signal of the digital operation unit triggers the inverter, a triggered signal is sent out to the diode buffer for controlling the luminous diode for a lighting-extinguishing flashing operation; wherein, when the inferior high coefficient heat sensor senses a heat coefficient, its output signal is transferred through the digital operation unit to trigger the inverter and the NOR gate separately, through the diode buffer to drive the luminous diode and through the buzzer buffer to drive the buzzer, respectively, into intermittent alarming; and when the high coefficient heat sensor senses a heat coefficient, its output signal is transferred through the digital operation unit to cause the inverter and the NOR gate to conduct non-intermittently to create an uninterrupted alarm signal output;

a power capacity checking circuit, which comprises an operational amplifier comparator, series resistance elements and an A/D converter, in which the series resistance provides an internal setting coefficient for comparing with the device's power capacity coefficient by the comparator, wherein if the device's power capacity coefficient is lower than the internal setting coefficient, the comparator output signal is converted into a digital signal by the checking circuit A/D converter, and sent out through the digital operation unit to cause the oscillating signal of the oscillator drive the luminous diode flashing;

a coercing alarm circuit, which includes a manual switch and a flip-flop, such that when opening the switch, an input signal is sent to the digital operation unit to stop all detecting operation and to send out a coercing alarm signal, the coercing alarm signal is deciphered by a decoder connected to said NOR gate and drive the buzzer into an alarm state.

* * * * *